US009623678B1

(12) United States Patent
Arredondo et al.

(10) Patent No.: US 9,623,678 B1
(45) Date of Patent: Apr. 18, 2017

(54) MOVEMENT OF A MEDIUM

(71) Applicant: HEWLETT-PACKARD DEVELOPMENT COMPANY, L.P., Houston, TX (US)

(72) Inventors: Alberto Arredondo, Sant Cugat del Valles (ES); Alberto Borrego Lebrato, Sant Cugat del Valles (ES); Eduardo Martin Orue, Sabadell (ES); Martin Urrutia Nebreda, Sant Cugat del Valles (ES); Isidoro Maya, Sant Cugat del Valles (ES)

(73) Assignee: HEWLETT—PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/927,648

(22) Filed: Oct. 30, 2015

(51) Int. Cl.
*B41J 11/00* (2006.01)
*B41J 2/01* (2006.01)

(52) U.S. Cl.
CPC ..... *B41J 11/007* (2013.01); *B41J 11/0085* (2013.01); *B41J 2/01* (2013.01)

(58) Field of Classification Search
CPC ..... B41J 11/007; B41J 11/0085; B41J 2/01
See application file for complete search history.

(56) References Cited

U.S. PATENT DOCUMENTS 3,884,623 A * 5/1975 Slack ..... G03G 15/2053 100/176
4,946,297 A * 8/1990 Koike ..... B41J 2/32 101/93.11
5,203,549 A * 4/1993 Bryson, Sr. ..... B65H 39/055 270/1.02
5,605,777 A * 2/1997 Ando ..... B41M 7/0009 399/343
5,655,201 A * 8/1997 Islam ..... G03G 15/6573 399/322
5,689,789 A * 11/1997 Moser ..... G03G 15/2053 219/216
5,737,679 A * 4/1998 Uehara ..... G03G 15/206 399/329
5,820,122 A * 10/1998 Schneider ..... B65H 29/12 271/188

(Continued)

FOREIGN PATENT DOCUMENTS

WO WO-0142030 6/2001

OTHER PUBLICATIONS

HP Scitex FB910 Printer, Jan. 29, 2008 (4 pages).

*Primary Examiner* — Justin Seo
(74) *Attorney, Agent, or Firm* — HP Inc—Patent Department

(57) ABSTRACT

An apparatus includes a plurality of transport elements to cause a movement of a medium received at a media input in a movement direction towards a media output, wherein the plurality of transport elements are arranged spaced apart from each other in the direction transverse to the movement direction of the medium, wherein the plurality of transport elements include a first transport element to be moved with a first velocity, a second transport element to be moved with a second velocity, and a third transport element to be moved with a third velocity, the second transport element arranged between the first and third transport elements, and wherein the first and third velocities are greater than the second velocity.

18 Claims, 12 Drawing Sheets

(56) References Cited

U.S. PATENT DOCUMENTS

| | | | | |
|---|---|---|---|---|
| 5,961,234 | A * | 10/1999 | Uchikata | B41J 13/02 347/104 |
| 6,665,512 | B1 * | 12/2003 | Yanagida | G03G 15/1685 399/308 |
| 7,289,248 | B2 * | 10/2007 | Yamazaki | B41J 2/04508 347/15 |
| 8,303,106 | B2 * | 11/2012 | Kasiske, Jr. | B41J 15/16 271/188 |
| 8,303,107 | B2 * | 11/2012 | Kasiske, Jr. | B41J 11/0015 271/188 |
| 8,886,098 | B2 | 11/2014 | Fromm | |
| 9,004,629 | B2 | 4/2015 | de Jong et al. | |
| 9,090,424 | B1 | 7/2015 | Armbruster et al. | |
| 2002/0021312 | A1 * | 2/2002 | Matsumoto | B41J 11/007 347/1 |
| 2009/0184463 | A1 * | 7/2009 | Shakespeare | B65H 20/02 271/265.01 |
| 2010/0007082 | A1 * | 1/2010 | Muller | B65H 5/021 271/228 |
| 2010/0054826 | A1 * | 3/2010 | Hieda | B65H 23/022 399/313 |
| 2010/0178089 | A1 * | 7/2010 | Fukuhata | G03G 15/2053 399/333 |
| 2012/0223117 | A1 * | 9/2012 | Kasiske, Jr. | B65H 27/00 226/1 |
| 2012/0223118 | A1 * | 9/2012 | Piatt | B65H 27/00 226/181 |
| 2014/0083824 | A1 * | 3/2014 | Shoji | B65G 15/54 198/846 |

* cited by examiner $V1 > V2 > V3 = V4 < V5 < V6$

MOVEMENT OF A MEDIUM

BACKGROUND

For processing a medium, for example, printing on a paper, the medium is moved through an area where the processing, for example the printing, takes place. The processing may be performed while the medium is continuously moved.

BRIEF DESCRIPTION OF THE DRAWINGS

FIG. 12 shows an example media transport including transport rollers for moving a medium from a media input to a media output, wherein FIG. 12A is a schematic, cross sectional side view of a printer including the media transport, wherein

FIG. 13 shows examples of a hold down device to hold down the medium on the platen, wherein FIG. 13A shows an example of the hold down device including a vacuum source, wherein FIG. 13B shows an example of the hold down device having a source of pressurized air and a nozzle, wherein FIG. 13C shows an example of the hold down device including a roller biased against the platen, and wherein

DETAILED DESCRIPTION

Figure 1:
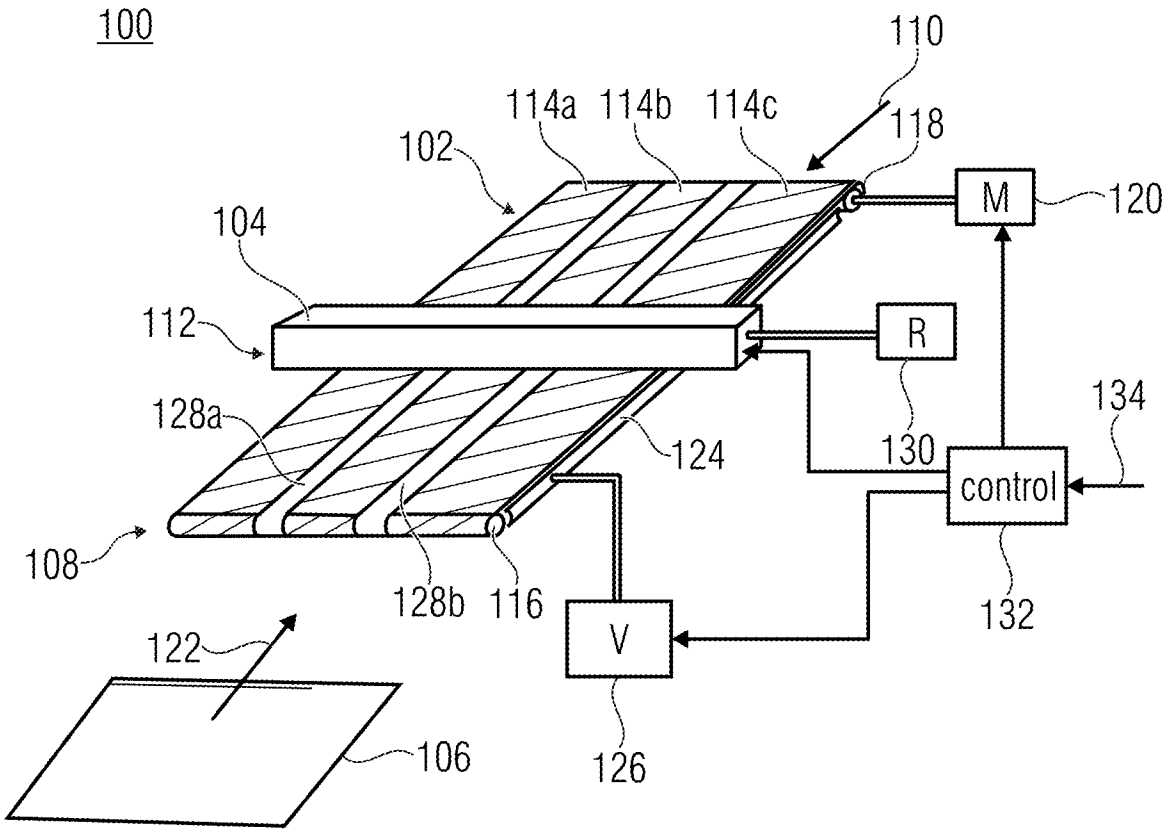
FIG. 1 is a schematic diagram of an example page wide array printer including a media transport.

The following detailed description refers to the accompanying drawings. Wherever possible, the same reference numbers are used in the drawings and the following description to refer to the same or similar parts. While several examples are described in the following, modifications, adaptations, and other implementations are possible. Accordingly, the following detailed description does not limit the disclosed examples. Instead, the proper scope of the disclosed examples may be defined by the appended claims.

The techniques described herein relate to the movement of a medium received at a media input in a movement direction towards a media output. For example, a medium, such as a sheet of paper, is transported when processing the medium, for example when printing on the medium. Printers, such as inkjet printers or electrostatic printers may be used to apply an image to a medium by inserting the medium into the printer, moving it past a print zone where the image is applied by the appropriate technique and outputting the printed medium. In accordance with examples, the printer may be an inkjet printer having a carriage including a print head. The carriage is scanned in a direction substantially perpendicular to the medium movement direction. When reaching the print zone and when printing a line using the print head the medium is stopped. Once the carriage completed the printing of a line, the medium is advanced. In other printers, a static array of print heads or a single printhead spanning the media may be provided, and the print heads do not move while printing occurs. The medium may be moved along the media axis in a continuous mode. Such printers are also referred as page wide array or PWA printers.

When advancing the medium towards the print zone, for example in the above described printers, wrinkles may be generated by the paper movement. The wrinkles may cause a damage to the print head or may cause a paper jam. The techniques described herein avoid wrinkles and a damage to the print head or a jam. In the following, examples of the techniques disclosed herein are described in further detail with reference to a PWA printer using a static array of inkjet print heads, also referred as print head bar. However, the techniques described herein may also be applied in other printers, such as printers in which a print head is scanned across the medium for printing, or in printers using other print technologies, for example electrostatic printers. Also other processing devices for acting on a medium, such as a sheet of paper, in which the medium is to be transported to a processing zone may use the techniques described herein, for example a cutter for cutting paper web into single sheets of paper, for accurately positioning the paper web when cutting.

FIG. 1 is a schematic diagram of an example page wide array (PWA) printer 100 including a media transport. The printer 100 includes a media transport 102 and a static print bar 104 having a static array of a plurality of print heads, for example inkjet print heads. The media transport 102 moves a print medium 106, for example a sheet of paper or a paper web, from a media input 108 to a media output 110 past a print zone 112. The print zone 112 may be the an area in which the print bar 104 applies the image to be printed onto the medium 106. In accordance with examples, the area between the media input 108 and the media output 110 may be referred to as the print zone 112. The media transport 102 includes a plurality of transport belts 114*a*, 114*b*, 114*c*. The transport belts 114*a* to 114*c* extend around an input side shaft 116 and an output side shaft 118, of which the output side shaft 118 is driven by a motor 120. The motor 120 drives the output side shaft 118 so that the transport belts 114*a* to 114*c* transport the medium 106 which is placed on top of the transport belts in the direction as indicated by the arrow 122, also referred to as the movement direction. The transport belts 114*a* to 114*c* extend in parallel along the movement direction 122 and are spaced apart from each other in a direction traverse, for example perpendicular, to the movement direction 122. The printer 100 includes a platen 124 arranged between the input side shaft 116 and the output side shaft 118. The transport belts 114*a* to 114*c* extend across the platen 124 from the media input 108 to the media output 110. The platen 124 may include a plurality of holes, not shown in FIG. 1, so as to allow applying a vacuum force by a vacuum source 126. The transport belts 114*a* to 114*c* may be vacuum belts including a plurality of holes so as to allow applying the vacuum provided by the vacuum source 126 to a medium 106 that is placed on the respective transport belts for holding the medium on the transport belt for allowing a transport thereof. The transport belts 114*a* to 114*c* are arranged spaced apart from each other in a direction perpendicular to the movement direction 122, thereby defining areas 128*a*, 128*b* between the respective transport belts in which, for example, the surface of the platen 124 is exposed. In accordance with examples, the platen 124 may also include vacuum holes in the areas 128*a*, 128*b*, for example in the print zone area 112. The print zone 112 includes traction areas formed by the respective transport belts 114*a* to 114*c* and the non-belt areas 128*a*, 128*b*. The non-belt areas 128*a*, 128*b* may be friction areas in which a vacuum is applied to the medium 106 by the vacuum source 126 to hold down the medium 106 on the platen 112 for maintaining a defined distance between the medium and the print bar 104, e.g. to avoid media crashes with the print bar 104 upon printing and for obtaining a good printing quality. In accordance with examples, the medium, when being moved by the media transport, is not subjected to an back tension.

The printer 100 may further include a reservoir 130 holding the printing fluid to be printed onto the medium. The reservoir 130 is coupled to the print bar 104 to supply the printing fluid for printing. Further, the printer includes a controller 132 that is coupled to the motor 120, to the print bar 104 and to the vacuum source 126 so as to control the movement of the transport belts via the motor 120, the suction force applied via the vacuum source 126, and the print bar 104 to cause forming an image on a surface of the medium 106. The controller 132 may receive input data from an exterior system, for example print data, causing an appropriate control of the printer 100, as is schematically depicted in by arrow 134.

Figure 2:
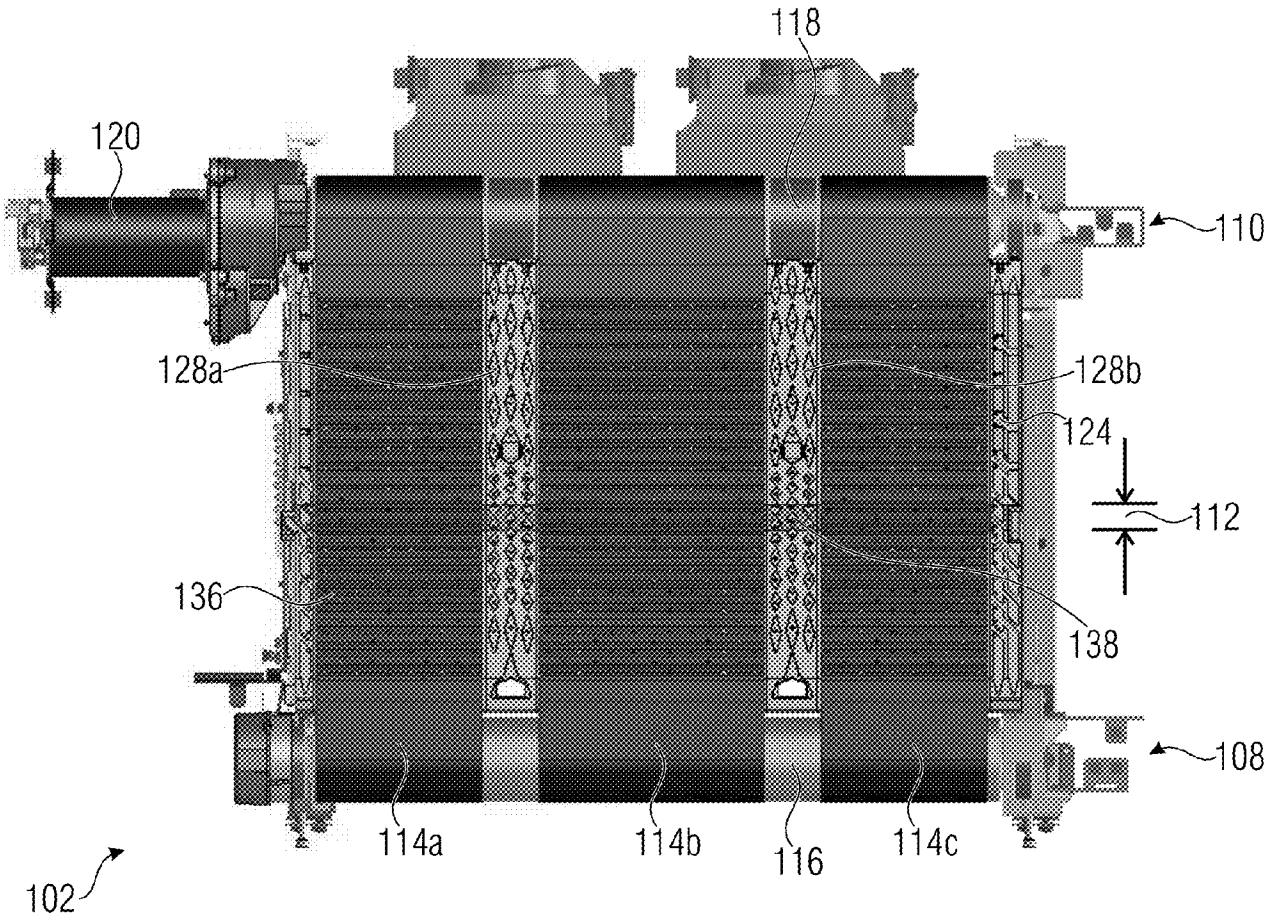
FIG. 2 shows an example media transport including three transport belts.

FIG. 2 shows an example media transport including three transport belts. The three transport belts 114*a* to 114*c* are arranged in the movement direction extending from the media input 108 to the media output 110 and being spaced apart with a distance from each other in a direction perpendicular to the movement direction. The transport belts 114*a* to 114*c* may be suction conveyor belts including, as mentioned with reference to FIG. 1, a plurality of holes 136 so as to allow applying a vacuum force from below for holding a medium for transporting the same on the transport belts. In the area 128*a* and 128*b* between the respective transport belts 114*a* to 114*c*, the print platen 124 is visible. The areas 128*a* to 128*b* include openings 138 to allow a vacuum force to be applied to a medium being transported across the platen 124. The size of the openings 138 in the non-belt areas or friction areas 128*a* and 128*b* have varying sizes. In accordance with examples, the openings 138 may include sinkholes fed by vacuum holes. The sinkholes 138 may increase the effective vacuum area.

The size of the sinkholes 138 in the friction areas 128*a* to 128*b* may decrease from the media input 108 towards the print zone 112 and may increase from the print zone 112 to the media output 110 so that the sinkholes at the media input 108 and the sinkholes at the media output 110 have a larger size when compared to the sinkholes at the print zone 112. This structure allows for increasing the suction force applied to the medium in the friction area from a low suction force due to the large openings at the media input 108 to a higher force at the print zone 112 so that the media, at the print zone and an area around the print zone is securely held down onto the platen 124. The suction force applied to the medium once it has left the print zone 112 is reduced due to the increase in the size of the sinkholes, so that the medium, when reaching the media output 110, may be easily removed from the platen.

In a multi-belt system, as it is depicted in FIG. 2, a difference in advance between the transport belts 114*a* to 114*c* may introduce wrinkles, for example when using paper having a low stiffness. In other words, in case the surfaces of the respective transport belts 114*a* to 114*c* travel with different speeds, wrinkles may be introduced by the uneven paper movement which may cause paper jams, image quality defects or even damages to the print bar 104. The different velocities or speeds of the parts of the transport elements which contact the medium, e.g. the contact surfaces of the transport belts, may be due to differences in the height of the pitch line above the platen, e.g. the differences in thickness of the respective transport belts. The transport belts 114*a* to 114*c* may be mounted to the shafts 116 and 118 of which shaft 118 is driven by motor 120, and a difference in the thickness of the transport belts results in respective different tangential speeds of the surfaces of the transport belts. For example, differences in the transport belt thickness in the range of 10 to 20 μm may cause wrinkles in low stiffness paper.

One possibility to avoid wrinkles is to control the thickness of the transport belts, for example during manufacturing of the transport belts, such that the thickness among the transport belts differs not more than 10 μm, i.e. the difference in pitch line height is lower than 10 μm. However, this goes together with an increase of the cost of the transport belt because of the more expensive manufacturing process for ensuring the tight tolerances and as a consequence increases the cost associated with a printer including such a media transport.

The techniques described herein avoid wrinkles when transporting a medium in a multi-transport element system without tightly controlling the dimensions of the actual transport elements by locating faster transport belts, for example transport belts 114*a* and 114*c*, on the lateral sides of the platen so as to stretch the medium at the media input while it is moved. The transport belts 114*a* and 114*c* may have a thickness greater than the thickness of the transport belt 114*b*. The transport belts are driven by the motor 120 with the same speed, however, because of the different thicknesses the tangential speeds of the surfaces of the transport belts 114*a* and 114*c* is faster than the tangential speed of the surface of the transport belt 114*b*. This causes a stretching of the medium at the media input 108 so that the medium, when being transported, arrives in the print zone 112 flat. In the print zone 112, a media compression may occur which cause wrinkles. The media compression is avoided by holding the medium down in the print zone by a hold down device, e.g. the vacuum system of FIG. 1 applying a vacuum force to the medium in the areas 128*a*, 128*b* between adjacent transport belts.

In the examples described above, the media transport 102 includes three transport belts 114*a* to 114*c*. As is depicted in FIG. 2, the transport belts may have different widths in the direction perpendicular to the media movement direction 122, however, in accordance with other examples the transport belts may have the same widths. In accordance with other examples, more than three transport belts may be used.

Figure 3:
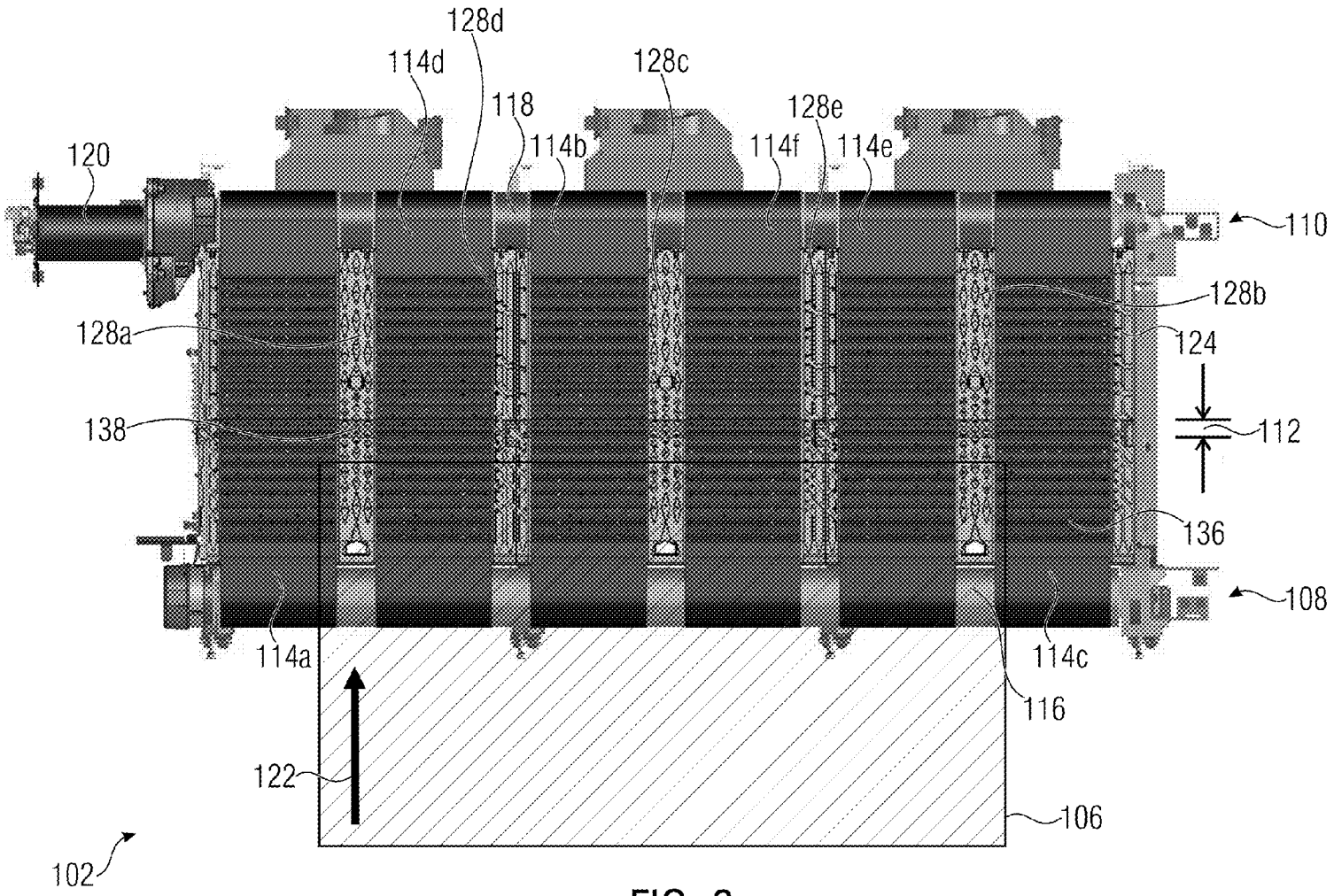
FIG. 3 shows an example media transport including six transport belts.

FIG. 3 shows an example media transport including six transport belts 114*a* to 114*f* extending in parallel to each other from the media input 108 to the media output 110 and being spaced apart from each other in the direction perpendicular to the media movement direction 122, thereby defining the areas 128*a* to 128*e* between adjacent transport belts exposing the platen 124. A fourth transport belt 114*d* is arranged between the first and second transport belts 114*a* and 114*b*, a fifth transport belt 114*e* is arranged between the second and third transport belts 114*b* and 114*c*, and a sixth transport belt 114*f* is arranged between the second and fifth transport belts 114*b* and 114*e*. The non-belt areas 128*a* to 128*c* are friction areas including the above described sinkholes with, for example, varying sizes for applying a suction to the medium 106 when being transported through the print zone 112 for holding down the print zone. The non-belt areas 128*d* and 128*e* do not include sinkholes, however, in accordance with examples also the non-belt areas 128*d* and 128*e* may be provided with sinkholes in a similar way as friction areas 128*a* to 128*c*. The transport belts may be vacuum conveyor belts including respective holes in the belt material to allow a vacuum force to be applied through the holes to the medium for holding it on the transport belts for movement from the media input 108 to the media output 110.

The medium 106, for example a sheet of paper, is moved by the transport belt system of FIG. 3 in the movement direction 122 from the media input 108 to the print zone 112 where the print heads are located. After printing the medium leaves the print platen 124 at the media output 110. The print platen 124 includes the friction areas 128*a* to 128*c* including the openings 138 to hold down the media and to control the distance between the media and the print head. The traction is provided by the transport belts to the medium the vacuum holes 136 so that the medium is securely attached to the surface of the transport belts and moved with the same speed as the transport belt surface. The difference in speed between the transport belts or the transport belt surfaces has an impact on the wrinkle appearance. In case one of the transport belts is running faster than a neighboring transport belt, a rotational force is applied to the medium causing wrinkles. This is avoided by moving the contact surfaces of the transport belts 114*a*, 114*d*, 114*e* and 114*c* faster than the contact surfaces of the transport belts 114*b* and 114*f*.

Figure 4:
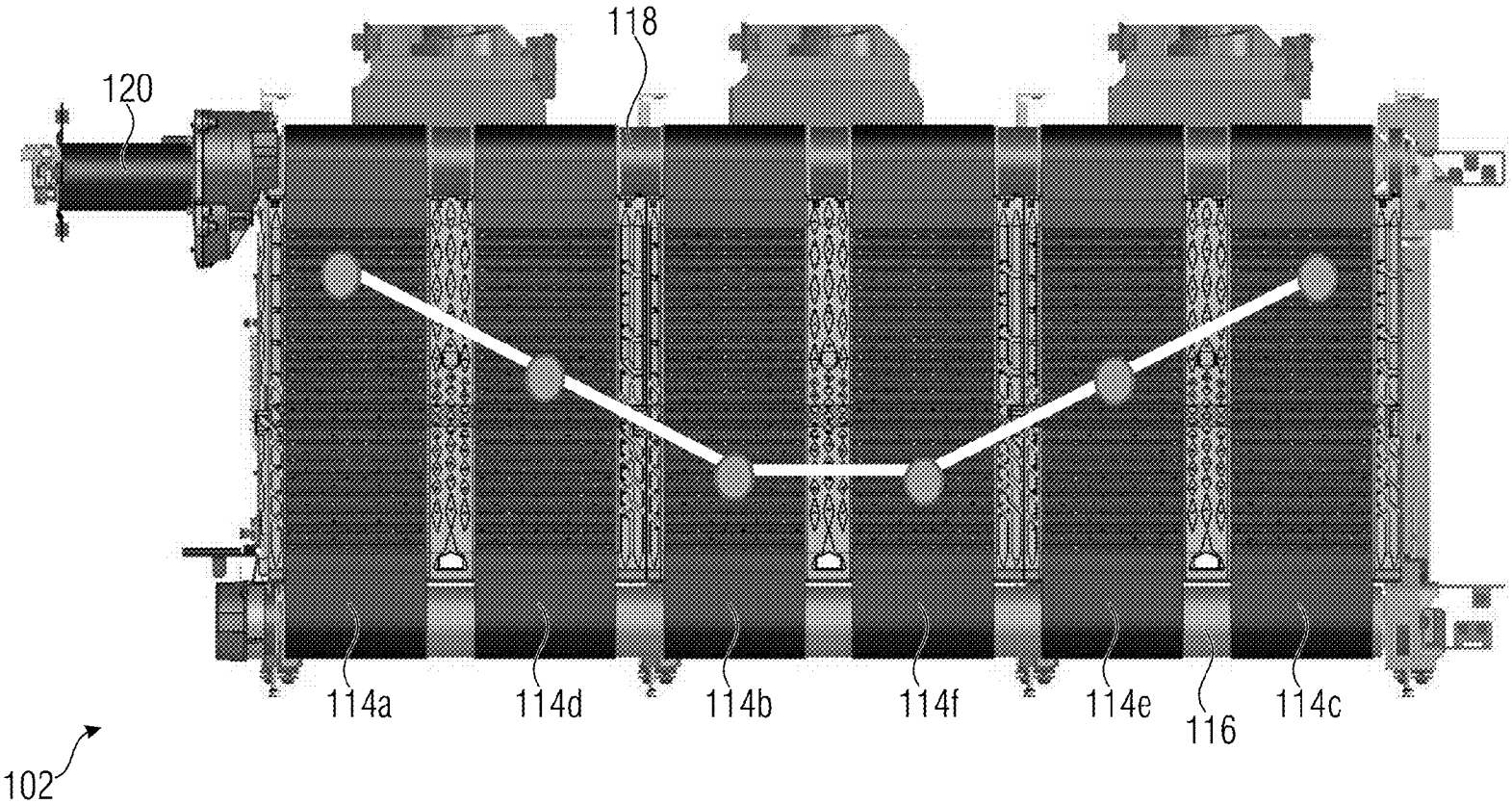
FIG. 4 is a representation of the media transport of FIG. 3 indicating the speed profile created by the different thicknesses of the transport belts.

FIG. 4 is a representation of the media transport of FIG. 3 indicating the speed profile created by the different thicknesses of the transport belts. The profile may also be referred to as a happy profile. The transport belt 114*a* and the transport belt 114*c* have the highest velocities V1, V6, the transport belts 114*b* and 114*f* have the lowest velocities V3, V4, and the transport belts 114*d* and 114*e* have a velocity V2, V5 between the velocities V1, V3 and V4, V6, respectively. In accordance with examples, the velocities V1 and V6 and the velocities V2 and V5 may be the same, and the velocities V3 and V4 may be the same.

Figure 5:
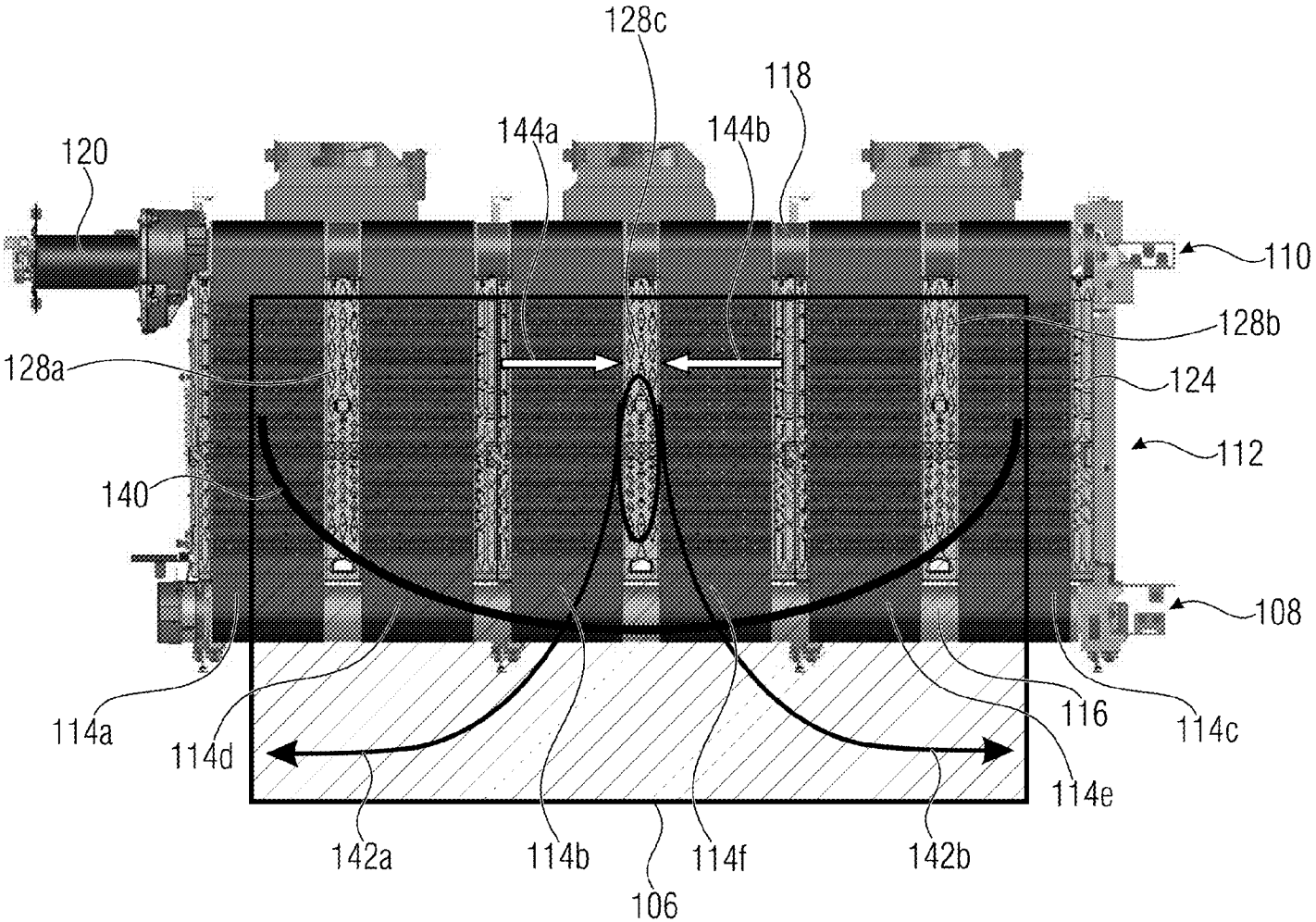
FIG. 5 is an example representation how wrinkles are avoided.

FIG. 5 is an example representation how wrinkles are avoided. The line 140 schematically represents the happy speed profile of the multi-belt system with the faster transport belts on the outside and the slower transport belts on the inside of the platen. The speed profile causes a stretching of the medium 106 at the media input 108, as is schematically represented by arrow 142*a* and by arrow 142*b*. The profile causes a media compression in the print zone and in an area between the print zone and the media output as it is indicated by arrows 144*a* and 144*b*. By stretching 142*a*, 142*b* the medium 106 at the media input 108 the medium 106 arrives in the print zone 112 substantially flat. The speed profile 140 causes the media compression 144*a*, 144*b* in the print zone and in the area between the print zone and the media output 110, however, in the friction areas 128*a* to 128*c* a vacuum is applied to the medium 106 holding it down on the platen, thereby providing a front tension to the medium, which avoids that wrinkles appear in the print zone 112 and in the area between the print zone 112 and the media output 110.

In accordance with examples, the thickness of the transport belts is different by at least 50 μm or more to provide for the speed profile 140. The outermost transport belts 114*a* and 114*c* are the thickest transport belts, and the transport belt thickness decreases towards the inside transport belts. In the example of FIG. 3, the transport belts 114*b* and 114*f* have the smallest thickness, and the transport belts 114*d* and 114*e* have a thickness between the thickness of the outermost transport belts 114*a*, 114*c* and the inner transport belts 114*b*, 114*f*.

Figure 6:
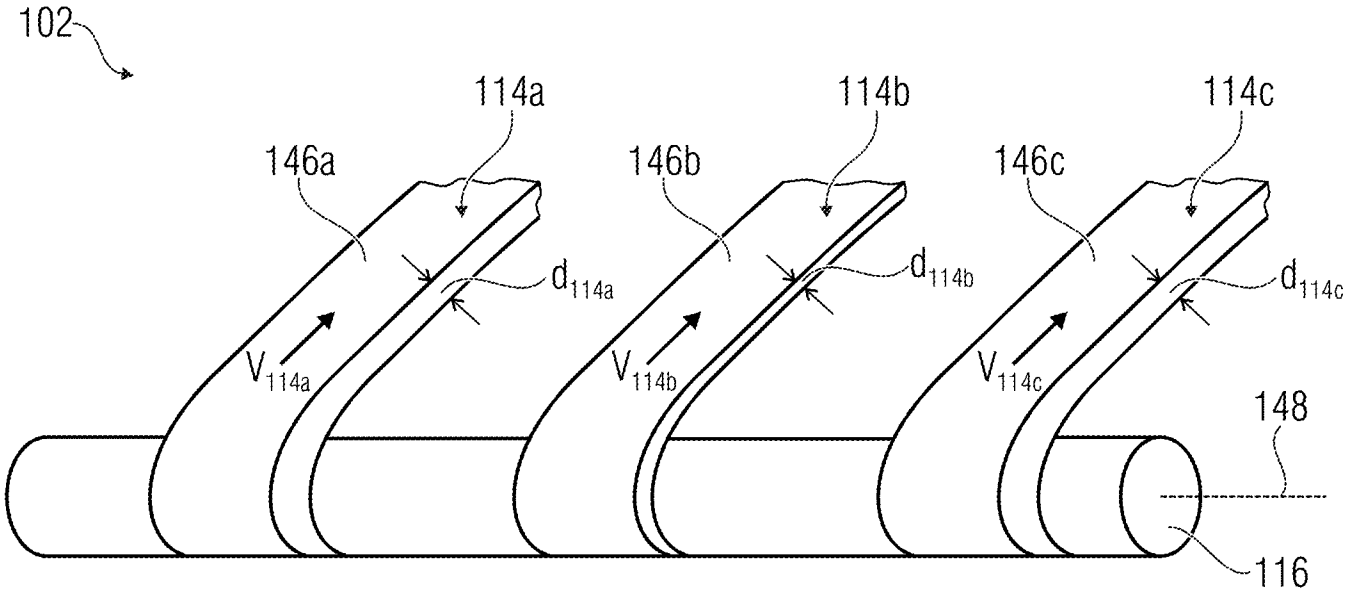
FIG. 6 is an enlarged view of an example input side shaft of the media transport of FIG. 1.

FIG. 6 is an enlarged view of an example input side shaft of the media transport of FIG. 1. The transport belts 114*a*, 114*b*, 114*c* having the different thicknesses are shown. The inner transport belt 114*b* has a thickness $d_{114b}$ being less than the thicknesses $d_{114a}$ and $d_{114c}$ of the outer transport belts 114*a* and 114*c*. The transport belts are driven by the same motor, but because of the different thicknesses of the transport belts, the surfaces 146*a* to 146*c*, in view of the different distances from the axis 148 of the shaft 116, have different tangential velocities $v_{114a}$ to $v_{114c}$.

Figure 7:
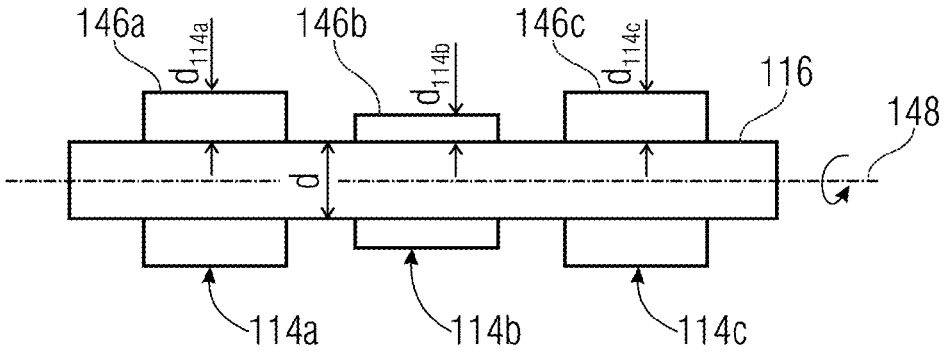
FIG. 7 is a cross sectional view of FIG. 6 showing the different thicknesses of the transport belts.

FIG. 7 is a cross sectional view of FIG. 6 showing the different thicknesses of the transport belts. The cross sectional view is along the axis 148. In accordance with the examples described above, the shaft 116 has a constant diameter d.

Figure 8:
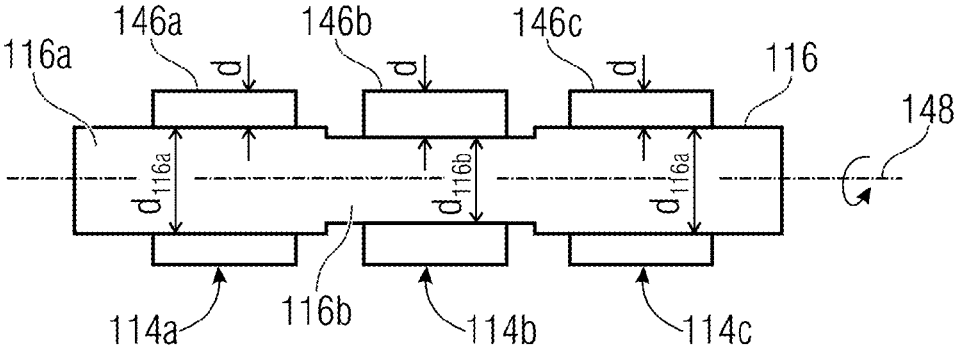
FIG. 8 shows an example of supporting and driving the transport belts using a shaft having transport belt support sections of different diameters.

FIG. 8 shows an example of supporting and driving the transport belts using a shaft having transport belt support sections of different diameters. Instead of using transport belts having different thicknesses, the transport belts 114*a* to 114*c* have substantially the same thickness d, for example a thickness of the each of the transport belts is the same within the tolerances of the manufacturing process. To obtain the different velocities or tangential velocities for the surfaces 146*a* to 146*c* of the transport belts 114*a* to 114*c*, the shaft 116 has sections 116*a* to 116*c* with different diameters d116*a* to d116*b*. The diameters of the outermost portions 116*a* and 116*c* are greater than the diameter 116*b* of the inner portion 116*b* so that a distance of the contact surface 146*b* of the inner transport belt 114*b* to the axis 148 of the shaft 116 is less than the distance of the respective contact surfaces 146*a* and 146*c* of the outer transport belts 114*a* and 114*c*. Therefore, when rotating the transport belts using a shaft 116 as shown in FIG. 8, the contact surfaces 146*a* and 146*c* move faster than the contact surface 146*b*.

Figure 9:
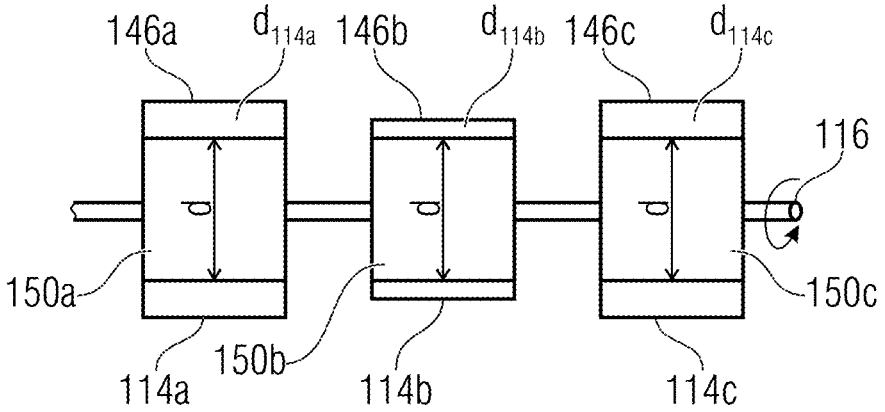
FIG. 9 shows an example of supporting and driving the transport belts using a shaft having mounted thereto a plurality of rollers of substantially the same diameter.

FIG. 9 shows an example of supporting and driving the transport belts using a shaft having mounted thereto a plurality of rollers 150*a* to 150*c* of substantially the same diameter. The rollers 150*a* to 150*c* are mounted to the shaft 116 with a gap there between. The transport belts 114*a* to 114*c* extend around the rollers 150*a* to 150*c*, and the transport belts have the different diameters $d_{114a}$ to $d_{114c}$ so that the contact surfaces 146*a* and 146*c* of the outermost rollers 114*a* and 114*c* moves faster than the contact surface 146*b* of the inner transport belt 114*b*, as has been described above.

Figure 10:
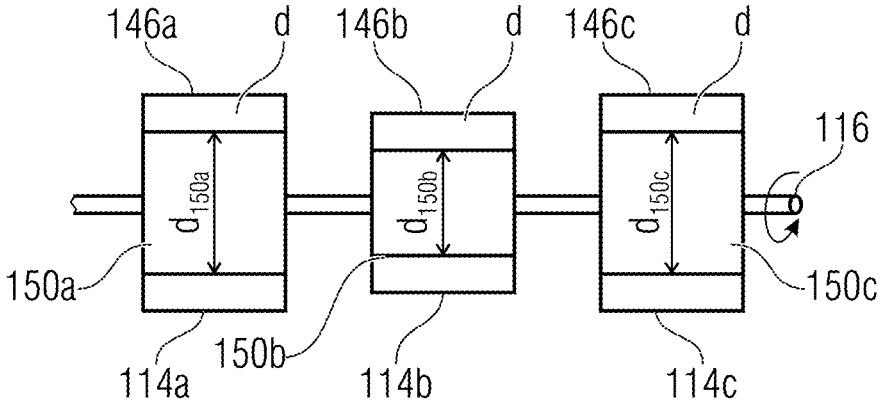
FIG. 10 shows an example of supporting and driving the transport belts using a shaft having mounted thereto a plurality of rollers of different diameters.

FIG. 10 shows an example of supporting and driving the transport belts using a shaft having mounted thereto a plurality of rollers of different diameters. The transport belts 114*a* to 114*c* have substantially the same diameter d, and the diameters of the rollers are different in that the outermost rollers 150*a* and 150*c* have larger diameters $d_{150a}$, $d_{150c}$ when compared to the diameter $d_{150b}$ of the inner roller 150*b*. Thus, the distance of the respective contact surfaces 146*a* to 146*c* to the axis of the shaft 116 is smaller for the inner roller when compared to the outer rollers so that the contact surfaces of the outer transport belts 114*a* and 114*c* move with a higher velocity than the contact surface 146*b* of the inner transport belt 114*b*.

Figure 11:
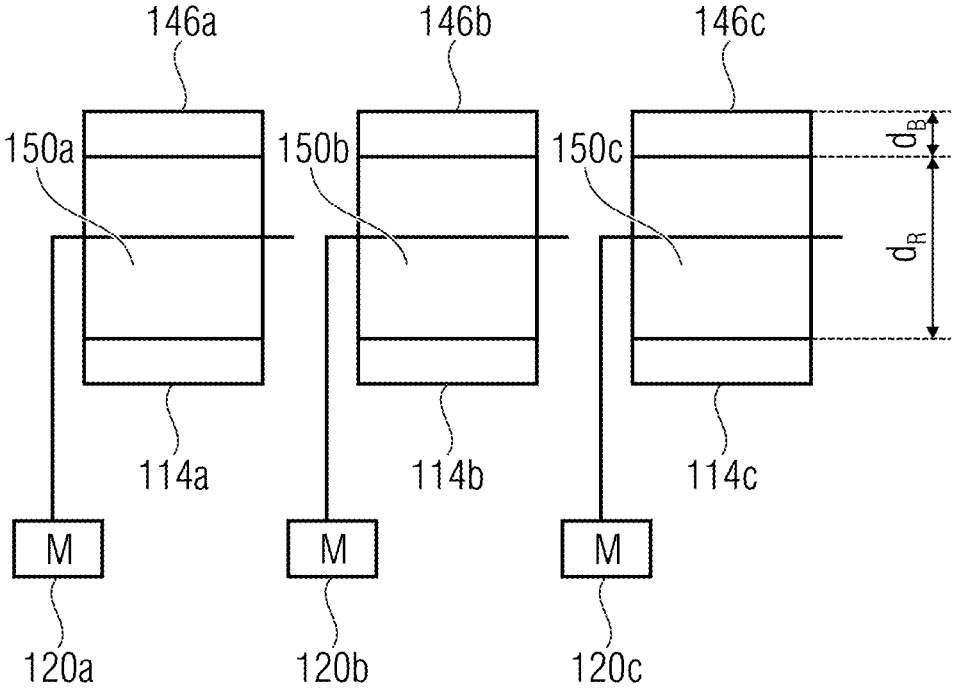
FIG. 11 shows an example of supporting and driving the transport belts using a plurality of individually driven rollers.

FIG. 11 shows an example of supporting and driving the transport belts using a plurality of individually driven rollers. Instead of a commonly driven shaft 116 as described in the examples so far, a plurality of individually driven rollers 150*a* to 150*c* are provided. Each of the rollers is driven by a motor 120*a* to 120*c* independent from the other ones of the rollers. The rollers 150*a* to 150*c* have the same diameter $d_R$, and the transport belts 114*a* to 114*c* have the same diameter $d_B$. The different velocity of the contact surfaces is achieved by controlling the rotation of the rollers via the motors 120*a* to 120*c*.

Figure 12A:
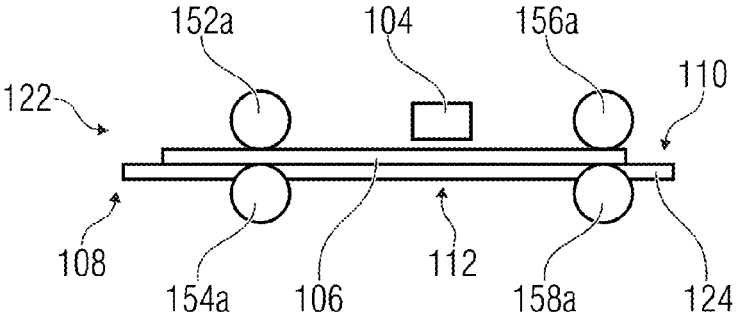

FIG. 12 shows an example media transport including transport rollers for moving a medium from a media input to a media output. Instead of transport belt conveyors, transport rollers move a medium from a media input to a media output. FIG. 12A is a schematic, cross sectional side view of a printer including the media transport. The elements already described above with reference to FIG. 1 are denoted with the same reference signs. A plurality of transport rollers are provided at the media input 108 along the direction traverse to the media movement direction 122, and in FIG. 12A a first roller 152*a* is shown. The transport rollers may act together with counter rollers, for example idling rollers. FIG. 12 A shows the counter roller 154*a*. In accordance with an example, the transport rollers may be provided at the media output 110. FIG. 12A shows the transport roller 156*a* and a counter roller 158*a*. The counter rollers 154*a*, 158*a* may extend through the plate 112 to allow engagement with the medium 106 in a nip between the rollers 152*a*, 154*a* and/or 156*a*, 158*a*. In accordance with examples, the transport rollers may be provided at the media input and 108/or at the media output 110.

Figure 12B:
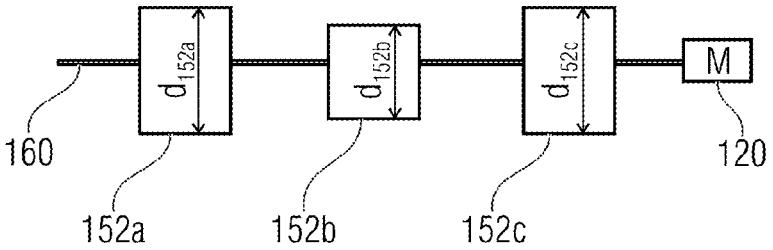
FIG. 12B shows example transport rollers of different diameters.

FIG. 12B shows example transport rollers of different diameters. The transport rollers 152*a* to 152*c* are commonly driven by a motor 112 connected to a common shaft 160 to which the transport rollers may be attached. The outer transport rollers 152*a*, 152*c* have diameters $d_{152a}$, $d_{152c}$ which are greater than the diameter $d_{152b}$ of the inner roller 152*b*. In accordance with examples more than three rollers with varying diameters may be used for transporting the medium 106.

Figure 12C:
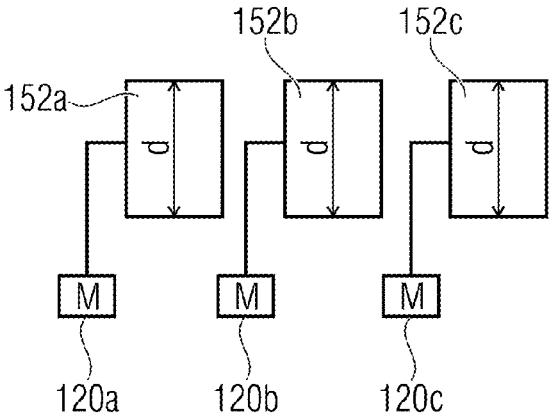
FIG. 12C shows an example of individually driven transport rollers.

FIG. 12C shows an example of individually driven transport rollers. The rollers 152*a* to 152*c* are individually driven by the motors 120*a* to 120*c*. Each of the rollers has substantially the same diameter d, and the velocity profile is controlled by driving the respective rollers 152*a* and 152*c* with a higher velocity than the roller 152*b*.

In accordance with examples, combinations of the above described examples of the transport elements for moving the medium may be used.

FIG. 13 shows examples of a hold down device to hold down the medium on the platen. FIG. 13A shows an example of the hold down device including the vacuum source 126 connected to a lower surface of the platen 124 via a channel 162. The channel 162 is coupled to a plurality of the openings 138 which extend from the lower surface of the platen 124 to the upper surface thereof, the upper surface facing the print bar 104. A suction force is applied to the medium through the openings 138, thereby holding down the medium 106 on the platen 124.

Figure 13A:
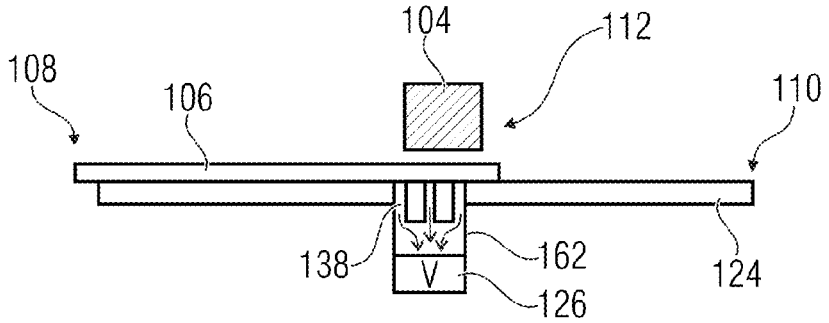
Figure 13B:
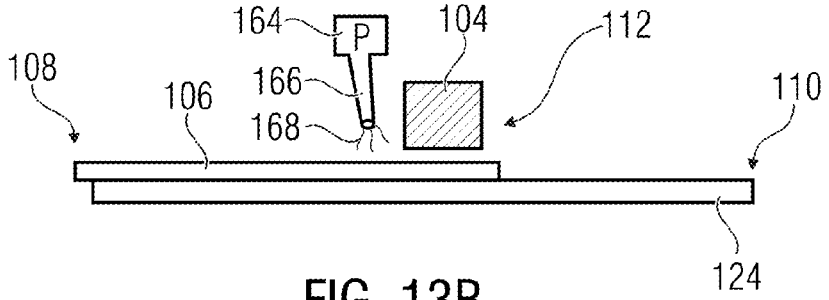

FIG. 13B shows an example of the hold down device having a source 164 of pressurized air which is directed via a nozzle 166 onto the medium 106, thereby forcing or holding the medium 106 down onto the platen 124. Instead of air, other gas may be used for generating the stream 168 of pressurized gas output from the nozzle 166 towards the medium 106.

Figure 13C:
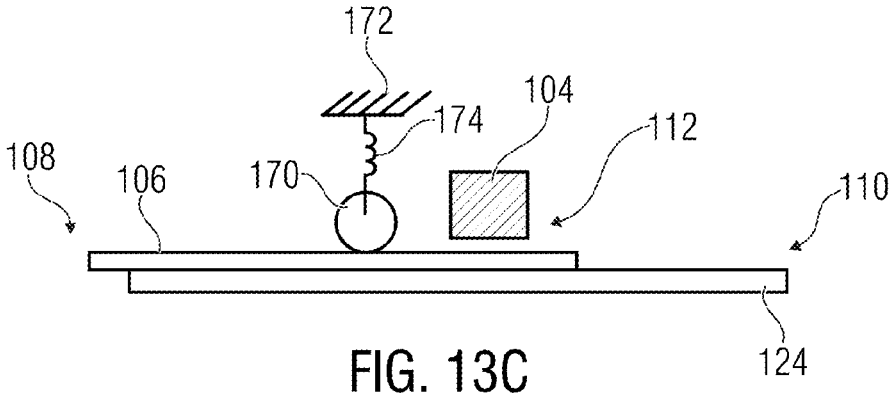

FIG. 13C shows an example of a hold down device including a roller 170 mounted to a support 172 via a spring element 174 for biasing the roller 170 in a direction towards the platen 124. The roller 170 is in contact with the medium 106, thereby holding it down in the print zone. The roller 170 may be an idle roller having an elastic surface.

Figure 13D:
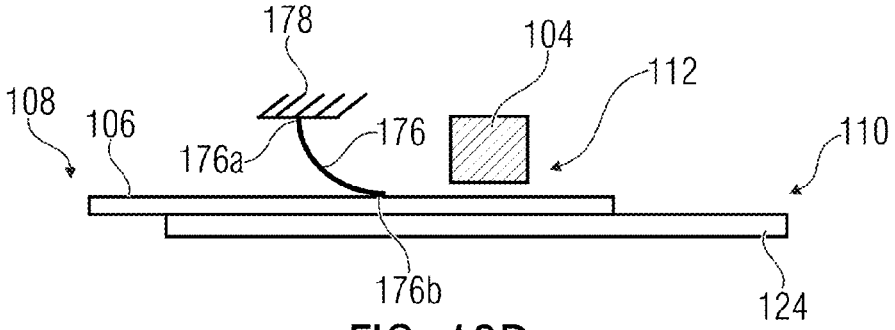
FIG. 13D shows an example of the hold down device including a flexible element biased against the platen.

FIG. 13D shows an example of the hold down device including a flexible element 176. The flexible element 176 may a flexible metal strip or a plurality of flexible metal strips having a fixed end 176*a* attached to a support 178, and having a free end 176*b* that rests on the surface of the platen when no medium is present. When a medium 106 is moved into the print zone, the free end of the flexible element 176 is displaced to act on the medium 106, thereby holding down the medium on the platen 124.

Figure 14:
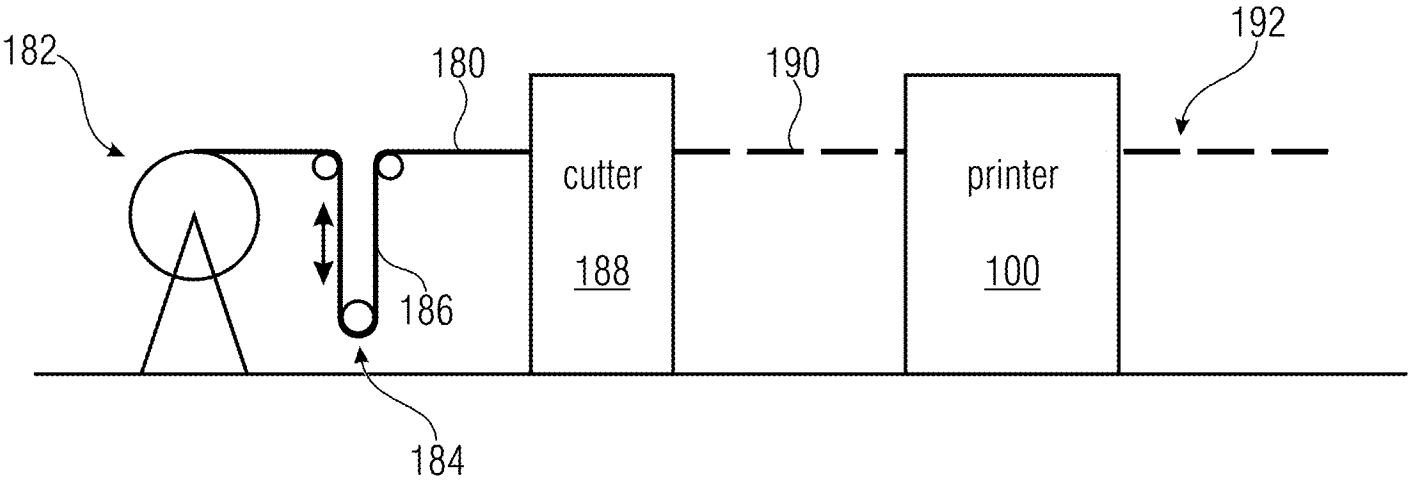
FIG. 14 shows an example of a printer or a printing system including the media transport.

FIG. 14 shows an example of a printer or a printing system including the above described media transport. In FIG. 14, the printer 100 is shown which includes the elements described above in further detail. The printer receives a paper web 180 that is, for example, provided from a paper reservoir 182. The paper reservoir 182 may include a roll of the paper web that is supplied towards the printer 100. The system comprises a cutter 188 receiving the paper web 180 and separating the web 180 into single sheets 190 which are fed to the printer 100 to be printed. The reservoir 182 and the cutter 188 are decoupled by a buffer 184 allowing to form a web loop 186. The paper web 180 is continuously fed to the cutter. The sheets 190 are moved through the printer with no back tension applied when being fed into the printer 100. The printer 100 prints on the sheets 180 and outputs the printed sheets 192. In accordance with another example, the cutter may be provided at the output of the printer. The printer receives the paper web from the paper reservoir. The reservoir and the printer are decoupled by the buffer. The paper web is continuously moved through the printer, wherein no tension is applied to the web when being fed into the printer. The cutter receives the printed paper web and separates the web into single sheets.

Examples described herein may be realized in the form of hardware, machine readable instructions or a combination of hardware and machine readable instructions. Any such machine readable instructions may be stored in the form of volatile or non-volatile storage, for example, a storage device such as a ROM, whether erasable or rewritable or not, or in the form of a volatile memory, for example, RAM, memory chips device or integrated circuits or an optically or magnetically readable medium, for example, a CD, DVD, magnetic disc or magnetic tape. The storage devices and storage media are examples of machine readable storage that is suitable for storing a program or programs that, when executed, implement examples described herein.

All of the features disclosed in this specification, including any accompanying claims, abstract and drawings, and/or all of the method or process so disclosed may be combined in any combination, except combinations where at least some of the features are mutually exclusive. Each feature disclosed in this specification, including any accompanying claims, abstract and drawings, may be replaced by alternative features serving the same, equivalent or similar purpose, unless expressly stated otherwise. Thus, unless expressly stated otherwise, each feature disclosed is one example of a generic series of equivalent or similar features.

The invention claimed is:

1. An apparatus, comprising:

a plurality of transport belts to cause a movement of a medium received at a media input in a movement direction towards a media output, wherein the plurality of transport belts are spaced apart from each other in a direction transverse to the movement direction of the medium, the plurality of transport belts comprising first, second, and third transport belts;

a controller to control movement of the first transport belt at a first velocity, control movement of the second transport belt at a second velocity, and control movement of the third transport belt at a third velocity, the second transport belt arranged between the first and third transport belts, and wherein the first and third velocities are greater than the second velocity.

2. The apparatus of claim 1, comprising:

a hold down device comprising a vacuum source to hold down the medium on a medium support surface, the hold down device further comprising openings in gaps between the plurality of transport elements, wherein a vacuum suction force is to be applied by the vacuum source on the medium through the openings.

3. The apparatus of claim 1, wherein:

the plurality of transport belts further comprise fourth, fifth, and sixth transport belts, the controller is to control movement of the fourth transport belt at a fourth velocity, control movement of the fifth transport element at a fifth velocity, and control movement of the sixth transport element at a sixth velocity, the fourth transport element is arranged between the first and second transport elements, the fifth transport element is arranged between the second and third transport elements, and the sixth transport element is arranged between the second and fifth transport elements, and the fourth and fifth velocities are greater than the second velocity and lower than the first and third velocities, and the second and sixth velocities are equal.

4. The apparatus of claim 1, wherein the first and third velocities are equal.

5. The apparatus of claim 1, comprising:

a first shaft arranged at the media input and a second shaft arranged at the media output; and a motor to drive the first shaft or the second shaft, wherein the controller is to control movement of the first, second, and third transport belts using the motor, wherein the plurality of transport belts extend around the first shaft and the second shaft, or around rollers mounted to the first shaft and to the second shaft.

6. The apparatus of claim 5, wherein the first transport belt and the third transport belt have a thickness greater than a thickness of the second transport belt.

7. The apparatus of claim 6, wherein a difference in the thickness of the first and third transport belts and the thickness of the second transport belt is 50 μm or more.

8. The apparatus of claim 5, wherein:

the first shaft and the second shaft have sections with different diameters or the rollers have different diameters, and the sections or rollers supporting the first transport belt and the third transport belt have a diameter greater than a diameter of the sections or rollers supporting the second transport belt.

9. The apparatus of claim 1, comprising:

a plurality of roller pairs, wherein each roller pair includes a first roller arranged at the media input and a second roller arranged at the media output, and wherein each roller pair supports a respective transport belt of the first, second, and third transport belts; and a plurality of motors to drive each of the roller pairs independently, wherein the motors are to drive the roller pair supporting the first transport belt with the first velocity, the roller pair supporting the second transport belt with the second velocity, and the roller pair supporting the third transport belt with the third velocity.

10. The apparatus of claim 1, wherein the first, second and third velocities are the velocities of a portion of the first, second and third transport belts which is in contact with the medium.

11. The apparatus of claim 1, wherein the plurality of transport belts are to continuously transport the medium from the media input to the media output without back tension.

12. A printer, comprising a media input;

a print zone to receive a medium to be printed;

a stationary printhead or array of printheads arranged to extend across the print zone;

a media output;

a plurality of transport belts to cause a movement of the medium received at the media input in a movement direction towards the media output, wherein the plurality of transport belts are spaced apart from each other in a direction transverse to the movement direction of the medium, the plurality of transport belts comprising first, second, and third transport belts; and a controller to control movement of the first transport belt at a first velocity, control movement of the second transport belt at a second velocity, and a third transport belt at a third velocity, the second transport belt arranged between the first and third transport belts, and wherein the first and third velocities are greater than the second velocity.

13. The printer of claim 12, comprising a medium buffer to receive a loop of a medium web, wherein the medium buffer is arranged upstream of the media input;

wherein the plurality of transport belts are to continuously transport the medium web free of back tension from the media input through the print zone to the media output.

14. The printer of claim 12, comprising:

a first shaft arranged at the media input and a second shaft arranged at the media output; and a motor to drive the first shaft or the second shaft, wherein the plurality of transport belts extend around the first shaft and the second shaft, or around rollers mounted to the first shaft and to the second shaft.

15. The printer of claim 12, wherein the first transport belt and the third transport belt have a thickness greater than a thickness of the second transport belt.

16. The printer of claim 15, wherein a difference in the thickness of the first and third transport belts and the thickness of the second transport belt is 50 μm or more.

17. The apparatus of claim 6, wherein the first shaft has a constant diameter along a length of the first shaft, and the second shaft has a constant diameter along a length of the second shaft.

18. The apparatus of claim 6, wherein a first roller mounted to the first shaft has a constant diameter along a length of the first roller, and a second roller mounted to the second shaft has a constant diameter along a length of the second roller.

* * * * *